US005891613A

United States Patent [19]

Zengerle et al.

[11] Patent Number: 5,891,613

[45] Date of Patent: Apr. 6, 1999

[54] SILVER HALIDE LIGHT-SENSITIVE ELEMENT

[75] Inventors: Paul L. Zengerle, Rochester; Gary N. Barber, Penfield, both of N.Y.

[73] Assignee: Eastman Kodak Company, Rochester, N.Y.

[21] Appl. No.: 916,882

[22] Filed: Aug. 22, 1997

[51] Int. Cl.[6] ..... G03C 7/36; G03C 7/388; G03C 7/392

[52] U.S. Cl. ..... 430/546; 430/551; 430/557

[58] Field of Search ..... 430/546, 551, 430/557

[56] References Cited

U.S. PATENT DOCUMENTS

| | | | |
|---|---|---|---|
| 2,322,027 | 6/1943 | Jelley et al. | 430/546 |
| 2,787,544 | 4/1957 | Godowsky et al. | 430/546 |
| 2,801,170 | 7/1957 | Vittum et al. | 430/546 |
| 3,676,141 | 7/1972 | Hara et al. | 430/377 |
| 3,973,968 | 8/1976 | Fujiwhara et al. | 430/546 |
| 4,057,432 | 11/1977 | Fujiwhara et al. | 430/389 |
| 4,221,860 | 9/1980 | Hirose et al. | 430/557 |
| 4,269,936 | 5/1981 | Arai et al. | 430/557 |
| 4,314,023 | 2/1982 | Kojima et al. | 430/557 |
| 4,327,175 | 4/1982 | Toda et al. | 430/546 |
| 4,404,274 | 9/1983 | Arai et al. | 430/557 |
| 4,456,681 | 6/1984 | Kadowaki et al. | 430/557 |
| 4,581,324 | 4/1986 | Wolff et al. | 430/557 |
| 4,748,107 | 5/1988 | Umemoto et al. | 430/557 |
| 4,770,985 | 9/1988 | Takada et al. | 430/557 |
| 4,782,011 | 11/1988 | Goddard et al. | 430/551 |
| 5,059,515 | 10/1991 | Leppard | 430/551 |
| 5,100,771 | 3/1992 | Mihayashi et al. | 430/557 |
| 5,173,398 | 12/1992 | Fukazawa et al. | 430/546 |
| 5,294,530 | 3/1994 | Seto et al. | 430/551 |
| 5,358,831 | 10/1994 | Bagchi et al. | 430/546 |
| 5,426,021 | 6/1995 | Krishnamurthy et al. | 430/551 |
| 5,441,855 | 8/1995 | Weber et al. | 430/551 |
| 5,441,861 | 8/1995 | Weber et al. | 430/551 |
| 5,466,569 | 11/1995 | Weber et al. | 430/551 |

FOREIGN PATENT DOCUMENTS

| | | |
|---|---|---|
| 0 508 398 A1 | 10/1992 | European Pat. Off. . |
| 0 538 862 B1 | 4/1993 | European Pat. Off. . |
| 0 374 837 B1 | 3/1995 | European Pat. Off. . |
| 4320828 | 6/1993 | Germany . |
| 4307439 | 11/1994 | Germany . |
| 1267287 | 3/1972 | United Kingdom . |
| 91/08515 | 6/1991 | WIPO . |

*Primary Examiner*—Richard L. Schilling
*Attorney, Agent, or Firm*—Andrew J. Anderson

[57] ABSTRACT

A silver halide light sensitive photographic element is disclosed comprising a support bearing at least one yellow image forming hydrophilic colloid layer comprising yellow image dye forming couplers and a substituted bisphenol light stabilizer compound which has a melting point of greater than 20° C., wherein the yellow image forming layer contains less than 10 wt % high boiling permanent solvent relative to the total amount of yellow coupler in the layer. In preferred embodiments of the invention, the yellow image forming layer is substantially free of high boiling permanent solvent. Light stability for yellow image dyes formed in an exposed and processed photographic element may be significantly improved where the yellow dyes are formed in a photographic layer which is substantially free of organic solvents, or which contains only a very low level of organic solvents, in combination with a substituted bisphenol light stabilizer compound which is a solid at room temperature.

20 Claims, No Drawings

SILVER HALIDE LIGHT-SENSITIVE ELEMENT

TECHNICAL FIELD

This invention relates generally to the field of silver halide light sensitive elements, and in particular to photographic elements having at least one yellow imaging layer which comprises yellow image dye forming couplers and a solid substituted bisphenol light stabilizer and which is substantially free of permanent high boiling coupler solvent or contains only very low levels of such solvents.

BACKGROUND OF THE INVENTION

Various techniques are known for dispersing hydrophobic photographically useful compounds such as photographic couplers into photographic element layer coating compositions comprising hydrophilic colloids.

Photographic dye forming couplers, as well as other hydrophobic photographically useful compounds, are typically incorporated into a hydrophilic colloid layer of a photographic element by first forming an aqueous dispersion of the couplers and then mixing such dispersion with the layer coating solution. An organic solvent is typically used to dissolve the coupler, and the resulting organic solution is then dispersed in an aqueous medium to form the aqueous dispersion.

The organic phase of these dispersions frequently includes high boiling or permanent organic solvents, either alone or with low boiling or water miscible solvents which are removed after dispersion formation. Permanent high boiling solvents have a boiling point sufficiently high, generally above 150° C. at atmospheric pressure, such that they are not evaporated under normal dispersion making and photographic layer coating procedures. Permanent high boiling coupler solvents are primarily used in the conventional "oil-protection" dispersion method whereby the organic solvent remains in the dispersion, and thereby is incorporated into the emulsion layer coating solution and ultimately into the photographic element.

The conventional "oil in water" dispersion method for incorporating hydrophobic couplers is described, e.g., in U.S. Pat. No. 2,322,027 by Jelly and Vittum. In such conventional process, the coupler is dissolved in a high boiling water immiscible solvent, mixed with aqueous gelatin, and dispersed using a colloid mill or homogenizer. The presence of the high boiling solvent provides a stable environment for the hydrophobic coupler, as well as generally increasing the reactivity of the coupler upon photographic processing.

U.S. Pat. No. 2,801,170 of Vittum et al. discloses preparing separate dispersions of a coupler and a high boiling point solvent and mixing the two dispersions with a silver halide emulsion. U.S. Pat. No. 2,787,544 of Godowsky et al. discloses a method of making mixed packet photographic systems. A dispersion of high boiling point solvent is mixed with a dispersion of coupler. Both these processes help prevent crystallization of the coupler prior to layer coating by keeping the solvent and the coupler separate until just prior to coating, while providing solvent in the coated layer to enhance coupler reactivity in the photographic element.

While the presence of high boiling solvents in certain coupler dispersions in photographic elements is frequently desirable to provide, e.g., adequate coupler reactivity upon photographic processing, lower thermal yellowing, modified dye hues, enhanced dye dark stability, and reduced crystallization, there are also certain advantages which may result from the substantial elimination of high boiling permanent solvent from a photographic element imaging layer. U.S. Pat. No. 5,173,398, e.g., discloses photographic elements with coupler-containing layers having substantially no high boiling solvent. Alternative methods for delivering hydrophobic materials, such as color couplers, to aqueous based photographic compositions without using high boiling solvents are well known in the art. Such techniques involve, e.g., deposition of the couplers from basic aqueous solutions or volatile low boiling or water miscible organic auxiliary solvents followed by removal of the auxiliary solvent by evaporation or washing, mechanical dispersion methods wherein solid compounds are directly dispersed in an aqueous composition, and latex loading methods wherein, e.g., a coupler is loaded into a latex polymer by mixing a solution of the coupler in a low boiling or water miscible organic solvent with an aqueous suspension of the latex followed by removal of the solvent. Minimizing the amount of permanent coupler solvent coated in a photographic element is useful, e.g., for reducing the coated thickness of photographic layers. Reductions in coupler solvent level also afford concomitant reductions in gelatin level which leads to further reductions in coated dry thickness. Layer thinning is advantageous for reasons such as improved image sharpness due to reduced light scattering during exposure and increased developability due to shorter diffusion paths through the multilayer structure. This increase in developability can lead to lower silver and/or coupler coated levels, hence lower materials cost.

The use of substituted bisphenols and blocked bisphenols as light stabilizers for yellow image dyes has been known for many years. These materials have been described in detail in, e.g., BP 1,267,287, DE 4,307,439, DE 4,320,828, EP 508,398, EP 538,862, U.S. Pat. No. 4,782,011, U.S. Pat. No. 5,294,530, U.S. Pat. No. 5,426,021, U.S. Pat. No. 5,441,855, U.S. Pat. No. 5,441,861, U.S. Pat. No. 5,466,569, and WO 91/008,515. These documents all teach the use of these light stabilizers with yellow dye forming image couplers in the presence of an oil former, or coupler solvent. U.S. Pat. No. 5,059,515 also teaches that these light stabilizers are preferably dissolved in a high boiling solvent, the amount being preferably 10 to 100%, relative to the coupler. It is also noted in U.S. Pat. No. 5,059,515 that if the stabilizers are liquid, they can themselves act as photographic solvents. However, it is stated that it is required for such embodiment that the stabilizers be so free-flowing that they have the properties of known photographic solvents such as di-n-butyl phthalate or tricresyl phosphate.

It would be advantageous to be able to provide a yellow image forming layer in a photographic element which has no or only very low levels of permanent solvent to enable the advantages discussed above, while including light stabilizers to effectively enable good yellow dye light stability.

It has been unexpectedly discovered that the light stability for yellow image dyes formed in an exposed and processed photographic element may be significantly improved where the yellow dyes are formed in a photographic layer which is substantially free of organic solvents, or which contains only a very low level of organic solvents, in combination with a substituted bisphenol light stabilizer compound which is a solid at room temperature.

SUMMARY OF THE INVENTION

One embodiment of the invention comprises a silver halide light sensitive photographic element comprising a support bearing at least one yellow image forming hydrophilic colloid layer comprising yellow image dye forming couplers and a substituted bisphenol light stabilizer compound which has a melting point of greater than 20° C., wherein the yellow image forming layer contains less than 10 wt % high boiling permanent solvent relative to the total amount of yellow coupler in the layer.

In a preferred embodiment, a silver halide light sensitive photographic element is described comprising a support bearing on one side thereof at least one yellow image forming hydrophilic colloid layer comprising a blue-sensitive silver halide emulsion, a yellow image dye forming coupler and a substituted bisphenol light stabilizer compound which has a melting point of greater than 20° C., at least one cyan image forming hydrophilic colloid layer comprising red-sensitive silver halide emulsion and cyan image dye forming coupler, and at least one magenta image forming hydrophilic colloid layer comprising green-sensitive silver halide emulsion and magenta image dye forming coupler, wherein the yellow image forming layer contains less than 10 wt % high boiling permanent solvent relative to the total amount of yellow coupler in the layer.

In preferred embodiments of the invention, the yellow image forming layer is substantially free of high boiling permanent solvent.

ADVANTAGES

The photographic elements of the invention employing yellow imaging layers comprising solid substituted bisphenol light stabilizers and which are substantially solvent-free or contain only very low levels of permanent solvent exhibit especially good yellow image dye light stability.

DETAILED DESCRIPTION

The photographic elements of the invention comprise at least one yellow image forming hydrophilic colloid layer comprising yellow image dye forming couplers, a solid substituted bisphenol light stabilizer compound, and which contain only very low levels of high boiling permanent solvent (i.e., less than 10 wt % based upon the weight of yellow coupler), and more preferably which are substantially free of high boiling permanent solvent.

Substituted bisphenol light stabilizer compounds which may be used in accordance with the invention generally comprise bisphenol derivatives having two linked phenol rings wherein at least one of the phenol rings is substituted as described in the references cited above. Preferably, at least one of the phenolic hydroxy groups is also substituted with a blocking group. Such preferred blocked bisphenolic compounds are preferably of the following formula:

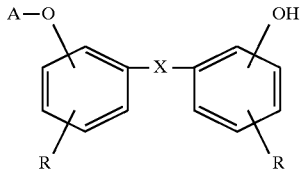

wherein A represents an alkyl (e.g., methyl, ethyl, propyl or butyl), cycloalkyl (e.g., cyclohexyl), alkenyl, aryl (e.g., phenyl), acyl (e.g., acetyl or benzoyl), alkylsulfonyl or arylsulfonyl substituent group, X represents a single bond or a bivalent linking group (e.g., an alkylidene group such as methyline, butylidine, or 3,3,5-trimethylhexylidene, or a heteroatom such as oxygen, sulfur, selenium, or tellurium, or a sulfonyl or phosphinyl group), and each R independently represents one or more alkyl, alkenyl, cycloalkyl, or aryl substituent group, such as described for A above, or in combination with the benzene ring to which it is attached represents the atoms necessary to complete a fused ring system. Each A, X and R substituent or linking group may be further substituted or unsubstituted. Specific examples of such blocked bisphenolic compounds, along with synthesis techniques, are disclosed, e.g., in U.S. Pat. Nos. 4,782,011 and 5,426,021, the disclosures of which are incorporated herein by reference. Bisphenol light stabilizer compounds for use in the instant invention may be selected from those disclosed therein which are solid at room temperature, i.e., which have a melting point of greater than 20° C.

The term "high boiling permanent solvent" as used herein refers to those coupler solvents which have conventionally been employed in the photographic industry, such solvents typically being water immiscible and having a boiling point of above 150° C. For the purposes of this invention, "substantially free of high boiling permanent solvent", "no-solvent", "solvent-free" and like terms are intended to denote the absence of permanent organic solvents beyond trace or impurity levels, while the term "low-solvent" and like terms are intended to denote levels of solvent below 10 wt % relative to the amount of yellow coupler. Yellow image forming layers in accordance with preferred embodiments of the invention which are substantially free of high boiling permanent solvents preferably contain 1.0 wt % or less relative to the total amount of yellow coupler in the layer, more preferably less than 0.5 wt %, and most preferably less than 0.1 wt % high boiling permanent solvent relative to the amount of yellow coupler. Such low-solvent and no-solvent dispersions of yellow image forming couplers have been found to provide improved performance with respect to yellow image dye fading problems in exposed and processed photographic elements in comparison to use of yellow coupler dispersions having significant permanent solvent levels.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

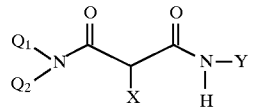

YELLOW-1

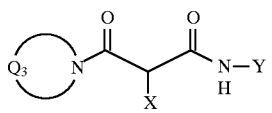

YELLOW-2

-continued

YELLOW-3

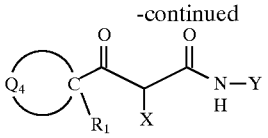

YELLOW-4

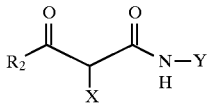

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Preferred couplers are of YELLOW-1 and YELLOW-4 wherein $Q_1$ and $Q_2$ each represent an alkyl group, an aryl group, or a heterocyclic group, and $R_2$ represents an aryl or alkyl group, including cycloalkyl and bridged cycloalkyl groups, and more preferably a tertiary alkyl group. Particularly preferred yellow couplers for use in elements of the invention are represented by YELLOW-4, wherein $R_2$ represents a tertiary alkyl group and Y represents an aryl group, and X represents an aryloxy or N-heterocyclic coupling-off group. The elements of the invention are particularly useful in combination with yellow couplers of the above formulas wherein X represents a nitrogen-containing heterocyclic coupling-off groups such as disclosed in concurrently filed, commonly assigned, copending application U.S. Ser. No. 08/916,842 (Kodak Docket No. 76462AJA), the disclosure of which is incorporated by reference herein.

The dispersions of yellow image forming couplers and solid bisphenol light stabilizer compounds for use in the invention can be prepared by dissolving the couplers and stabilizer compounds in low boiling or partially water soluble auxiliary organic solvents, or by melting the couplers and light stabilizer compounds. The resulting liquid organic phase may then be mixed with an aqueous gelatin solution, and the mixture is then passed through a mechanical mixing device suitable for high shear or turbulent mixing generally suitable for preparing photographic emulsified dispersions, such as a colloid mill, homogenizer, microfluidizer, high speed mixer, ultrasonic dispersing apparatus, blade mixer, device in which a liquid stream is pumped at high pressure through an orifice or interaction chamber, Gaulin mill, blender, etc., to form small particles of the organic phase suspended in the aqueous phase. More than one type of device may be used to prepare the dispersions. The auxiliary organic solvent, if present, may then be removed by evaporation, noodle washing, or membrane dialysis. If not removed prior to coating in a photographic element layer, partially water soluble auxiliary organic solvents may diffuse throughout the hydrophilic colloid layers of the element, and be removed during photographic processing. The dispersion particles preferably have an average particle size of less than 2 microns, generally from about 0.02 to 2 microns, more preferably from about 0.02 to 0.5 micron. These methods are described in detail in U.S. Pat. Nos. 2,322,027, 2,787,544, 2,801,170, 2,801,171, 2,949,360, and 3,396,027. Alternatively, other conventional high boiling permanent solvent-free dispersion techniques may be used, such as disclosed, e.g., in U.S. Pat. No. 5,173,398 referenced above, the disclosure of which is incorporated by reference herein. Separate dispersions of the yellow coupler and the bisphenol light stabilizer compound may be prepared and then added to the yellow image forming layer, or more preferably a single dispersion comprising both the yellow coupler and the bisphenol compound may be prepared. In either case, preferred weight ratios of yellow coupler to solid bisphenol compound in the yellow image forming layer of the photographic elements of the invention are at least about 1:4 and less than about 20:1, more preferably at least about 1:1 and less than about 10:1.

Examples of suitable auxiliary solvents which can be used include: ethyl acetate, isopropyl acetate, butyl acetate, ethyl propionate, 2-ethoxyethylacetate, 2-(2-butoxyethoxy) ethyl acetate, triethylcitrate, dimethylformamide, 2-methyl tetrahydrofuran, triethylphosphate, cyclohexanone, butoxyethyl acetate, methyl isobutyl ketone, methyl acetate, 4-methyl-2-pentanol, diethyl carbitol, 1,1,2-trichloroethane, 1,2-dichloropropane, and the like. Preferred auxiliary solvents include ethyl acetate and 2-(2-butoxyethyoxy) ethyl acetate.

The aqueous phase of the coupler and bisphenol light stabilizer compound dispersions preferably comprise gelatin as a hydrophilic colloid. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. Other hydrophilic colloids may also be used, such as a water soluble polymer or copolymer including, but not limited to poly(vinyl alcohol), partially hydrolyzed poly(vinylacetate-co-vinyl alcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

The photographic elements in accordance with preferred embodiments of the invention further comprise at least one cyan image forming hydrophilic colloid layer and at least one magenta image forming layer. More particularly, multicolor photographic elements in accordance with preferred embodiments of the invention preferably comprise a support bearing light sensitive image dye forming layers sensitized to the blue (approx. 380–500 nm), green (approx. 500–600 nm), and red (approx. 600–760 nm) regions of the electromagnetic spectrum. In accordance with a preferred embodiment of the invention, the element comprises cyan, magenta and yellow dye forming silver halide emulsion hydrophilic colloid layer units sensitized to the red, green and blue regions of the spectrum. Each unit can comprise a single emulsion layer or multiple emulsion layers sensitive to a given region of the spectrum. The layers of the element, including the layers of the image forming units, can be arranged in various orders as known in the art. It is within the scope of this invention, however, for the light sensitive material to alternatively or additionally be sensitive to one or more regions of the electromagnetic spectrum outside the visible, such as the infrared region of the spectrum. In most color photographic systems, color-forming couplers are incorporated in the light-sensitive photographic emulsion layers so that during development, they are available in the emulsion layer to react with the color developing agent that is oxidized by silver halide image development. Non-diffusing couplers are incorporated in photographic emulsion layers. When the dye image formed is to be used in situ, couplers are selected which form non-diffusing dyes. Color photographic systems can also be used to produce black-and-white images from non-diffusing couplers as described, e.g., by Edwards et al. in International Publication No. WO 93/012465.

The yellow image forming layers of the elements of the invention are particularly useful in combination with adjacent image forming hydrophilic colloid layers comprising cyan or magenta image dye forming couplers, wherein the adjacent image forming layer are substantially free of high boiling solvents having a logP value of less than about 5.5 such as disclosed in concurrently filed, commonly assigned, copending application U.S. Ser. No. 08/916,240 (Kodak Docket No. 75630AJA), the disclosure of which is incorporated by reference herein. The log P parameter is a well-known measurement of the solubility of a compound in aqueous liquids compared to its solubility in a nonpolar organic solvent (octanol).

The invention is particularly useful with color photographic print elements, and especially to photographic print elements designed for exposure though a negative film and projection display, such as motion picture print and intermediate films. In color photographic element printing, there are usually three records to record in the image area frame region of a print film, i.e., red, green and blue. The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York, and suitable materials useful to form original records are described in *Research Disclosure*, December, 1987, Item 17643, published by Industrial Opportunities Ltd., Homewell Havant, Hampshire, P09 1EF, United Kingdom, and *Research Disclosure*, September 1994, Item 36544, published by Kenneth Mason Publications, Ltd., Emsworth, Hampshire P010 7DQ, England. Materials in which such images are formed can be exposed to an original scene in a camera, or can be duplicates formed from such camera origination materials, e.g., records formed in color negative intermediate films such as those identified by the tradenames Eastman Color Intermediate Films 2244, 5244 and 7244. Alternatively, the original record may be in the form of electronic image data, which may be used to control a printer apparatus, such as a laser printer, for selective imagewise exposure of a print film in accordance with the invention.

Image dyes formed in photographic print elements designed for direct or projection viewing generally have been found to be far more susceptible to degradation due to light exposures than dyes formed in camera negative films, which are typically stored in dark conditions. Accordingly, the photographic elements of the invention in accordance with particular embodiments of the invention preferably comprise photographic print elements. Relatively small grain, high chloride emulsions (e.g., emulsions having average grain size equivalent circular diameters of less than about 1 micron and halide contents of greater than 50 mole % chloride) are typically used in photographic print films and papers in order to optimize print image quality and enable rapid processing. Such emulsions typically result in relatively low speed photographic elements in comparison to camera negative films. Low speed is compensated for by the use of relatively high intensity print lamps or lasers for exposing such print elements. For comparison purposes, it is noted that print films and papers, such as motion picture color print films, e.g., when rated using the same international standards criteria used for rating camera negative films, would typically have an ISO speed rating of less than 10, which is several stops slower than the slowest camera negative films in current use.

In the following discussion of suitable materials for use in the emulsions and elements that can be used in conjunction with the invention, reference will be made to *Research Disclosure*, September 1994, Item 36544, available as described above, which will be identified hereafter by the term "*Research Disclosure*." The contents of the Research Disclosure, including the patents and publications referenced therein, are incorporated herein by reference, and the Sections hereafter referred to are Sections of the *Research Disclosure*, Item 36544.

Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX.

It is also contemplated that the materials and processes described in an article titled "Typical and Preferred Color Paper, Color Negative, and Color Reversal Photographic Elements and Processing," published in *Research Disclosure*, February 1995, Item 37038 also may be advantageously used with elements of the invention.

Photographic light-sensitive print elements of the invention may utilize silver halide emulsion image forming layers wherein chloride, bromide and/or iodide are present alone or as mixtures or combinations of at least two halides. The combinations significantly influence the performance characteristics of the silver halide emulsion. Print elements are typically distinguished from camera negative elements by the use of high chloride (e.g., greater than 50 mole % chloride) silver halide emulsions containing no or only a minor amount of bromide (typically less than 40 mole %), which are also typically substantially free of iodide. As explained in Atwell, U.S. Pat. No. 4,269,927, silver halide with a high chloride content possesses a number of highly advantageous characteristics. For example, high chloride silver halides are more soluble than high bromide silver halide, thereby permitting development to be achieved in shorter times. Furthermore, the release of chloride into the developing solution has less restraining action on development compared to bromide and iodide and this allows developing solutions to be utilized in a manner that reduces the amount of waste developing solution. Since print films are intended to be exposed by a controlled light source, the imaging speed gain which would be associated with high bromide emulsions and/or iodide incorporation offers little benefit for such print films.

Photographic print elements are also distinguished from camera negative elements in that print elements typically comprise only fine silver halide emulsions comprising grains having an average equivalent circular diameter (ECD) of less than about 1 micron, where the ECD of a grain is the diameter of a circle having the area equal to the projected area of a grain. The ECDs of silver halide emulsion grains are usually less than 0.60 micron in red and green sensitized layers and less than 0.90 micron in blue sensitized layers of a color photographic print element. Such fine grain emulsions used in print elements generally have an aspect ratio of less than 1.3, where the aspect ratio is the ratio of a grain's ECD to its thickness. Such grains may take any regular shapes, such as cubic, octahedral or cubo-octahedral (i.e., tetradecahedral) grains, or the grains can take other shapes attributable to ripening, twinning, screw dislocations, etc. Typically, print element emulsions grains are bounded primarily by {100} crystal faces, since {100} grain faces are exceptionally stable. Specific examples of high chloride emulsions used for preparing photographic prints are provided in U.S. Pat. Nos. 4,865,962; 5,252,454; and 5,252,456, the disclosures of which are here incorporated by reference.

The yellow, cyan and magenta dye forming couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

Image dye forming couplers may be included in elements of the invention such as couplers that form cyan dyes upon reaction with oxidized color developing agents which are described in such representative patents and publications as: U.S. Pat. No. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

CYAN-1

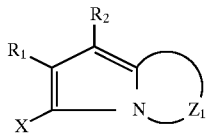

CYAN-2

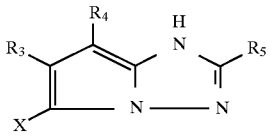

-continued

CYAN-3

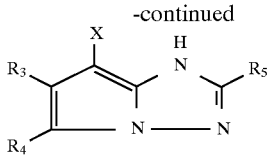

CYAN-4

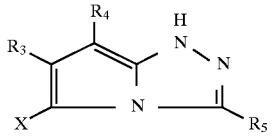

CYAN-5

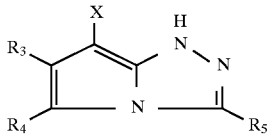

CYAN-6

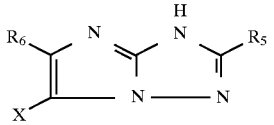

wherein $R_1$ and $R_5$ each represent a hydrogen or a substituent; $R_2$ represents a substituent; $R_3$ and $R_4$ each represent an electron attractive group having a Hammett's substituent constant $s_{para}$ of 0.2 or more and the sum of the $s_{para}$ values of $R_3$ and $R_4$ is 0.65 or more; $R_6$ represents an electron attractive group having a Hammett's substituent constant $s_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group. A dissociative group has an acidic proton, e.g. —N—, —CH(R)—, etc., that preferably has a pKa value of from 3 to 12 in water. The values for Hammett's substituent constants can be found or measured as is described in the literature. For example, see C. Hansch and A. J. Leo, *J. Med. Chem.,* 16, 1207 (1973); *J. Med. Chem.,* 20, 304 (1977); and J. A. Dean, *Lange's Handbook of Chemistry,* 12th Ed. (1979) (McGraw-Hill).

More preferable are cyan couplers of the following formulas:

CYAN-7

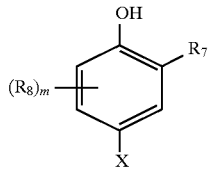

CYAN-8

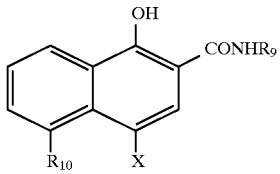

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonamido group); X represents a hydrogen or a coupling-off group; and m is from 1–3. Couplers of the structure CYAN-7 are most preferable for use in elements of the invention.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S. Pat. Nos. 4,659,652; 5,066,575; and 5,250,400.

Typical pyrazoloazole and pyrazolone couplers are represented by the following formulas:

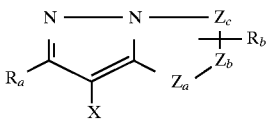

MAGENTA-1

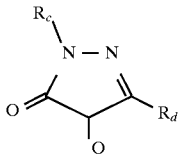

MAGENTA-2 wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$. Use of yellow image forming layers in accordance with the invention may be particularly useful in combination with magenta image forming layers comprising pyrazoloazole dye forming couplers of formula MAGENTA-1 to provide improved color reproduction performance.

Typical examples of photographic substituents which may be included in the yellow, cyan and magenta couplers which may be used in the elements of the invention include alkyl, aryl, anilino, carbonamido, sulfonamido, alkylthio, arylthio, alkenyl, cycloalkyl, and further to these exemplified are halogen, cycloalkenyl, alkynyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues. Usually the substituent will have less than 30 carbon atoms and typically less than 20 carbon atoms. It is understood throughout this specification that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any other photographically useful substituents.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to a polymeric backbone.

It may be useful to use a combination of couplers any of which may contain known ballasts or coupling-off groups such as those described in U.S. Pat. No. 4,301,235; 4,853,319 and 4,351,897.

If desired, the photographic element can be used in conjunction with an applied magnetic layer as described in *Research Disclosure*, November 1992, Item 34390. It is also specifically contemplated to use photographic elements according to the invention in combination with technology useful in small format film as described in *Research Disclosure*, June 1994, Item 36230. *Research Disclosure* is published by Kenneth Mason Publications, Ltd., Dudley House, 12 North Street, Emsworth, Hampshire P010 7DQ, ENGLAND.

Photographic elements in accordance with the invention may comprise any conventional support materials, which may be reflective or transparent. Preferred supports for elements in accordance with the invention comprise transparent polymeric films, such as cellulose nitrate and cellulose esters (such as cellulose triacetate and diacetate), polycarbonate, and polyesters of dibasic aromatic carboxylic acids with divalent alcohols such as poly(ethylene terephthalate). In addition to the light sensitive image forming layers described above, the photographic elements of the invention may include further features and layers as are known in the art, including, e.g., antistatic, antihalation, subbing, interlayer, backing, and overcoat layers. Polyester supports, e.g., typically employ undercoat or primer layers to improve adhesion of other layers thereto. Such undercoat layers are well known in the art and comprise, e.g., a vinylidene chloride/methyl acrylate/itaconic acid terpolymer or vinyldene chloride/acrylonitrile/acrylic acid terpolymer as described in U.S. Pat. Nos. 2,627,088; 2,698,235; 2,698,240; 2,943,937; 3,143,421; 3,201,249; 3,271,178; 3,501,301.

Photographic elements of the invention preferably comprise an antihalation layer comprising process removable filter dyes or silver. The antihalation layer may be located between the light sensitive layers and the support, or may be positioned on the back side of the support opposite to the light sensitive layers. The filter dyes and/or silver used in antihalation layers are preferably designed to be solubilized and removed or decolorized during photographic processing. Conventional processing of photographic print elements include the Kodak ECP-2B Process for motion picture print films, described in Kodak Publication No. H-24, Manual For Processing Eastman Color Films, the disclosure of which is hereby incorporated by reference.

The following examples illustrate the preparation of photographic elements in accordance with this invention.

EXAMPLE 1

36.0 g of yellow coupler Y-1 and 9.0 g of solid light stabilizer ST-1 (melting point=110° C.) were dissolved in 54.0 g of ethyl acetate at 75° C. This oil phase solution was then combined with an aqueous phase solution consisting of 24.0 g gelatin, 24.0 g of a 10% solution of Alkanol-XC (Dupont), and 253.0 g of distilled water. This mixture was then passed through a Gaulin colloid mill five times followed by removal of ethyl acetate by rotory evaporation. Distilled water was then added back to form Dispersion A which consisted of 9.0% coupler, 2.25% stabilizer, and 6.0% gel. Dispersions B through F were similarly prepared using yellow couplers Y-2 through Y-6, respectively, as described in Table I. Dispersions G through L were also similarly prepared using yellow couplers Y-1 through Y-6, respectively, except that 18.0 g of high boiling permanent solvent di-n-butylphthalate (DBP) was included in the oil phase and 235.0 g of distilled water was employed in the aqueous phase.

Dispersion A was incorporated in a bi-layer monochrome photographic element (element 1) by coating the following layers on a gelatin subbed polyethylene terephthalate support with a rem-jet carbon black containing backing layer.

Layer 1: Blue Light Sensitive Layer

AgCl cubic grain emulsion, 0.58 micron, spectrally sensitized with SD-1, 0.3336 mmole/Ag mole, 645.6 mg/sq. m.
AgCl cubic grain emulsion, 0.76 micron, spectrally sensitized with SD-1, 0.2669 mmole/Ag mole, 215.2 mg/sq. m.
Gelatin, 3163.4 mg/sq. m.
Yellow dye forming coupler (Y-1) from Dispersion A, 1883.0 mg/sq. m.
Light stabilizer (ST-1), 470.8 mg/sq. m.
Yellow dye cpd (YD-1), 23.0 mg/sq. m.
Sequestrant cpd (SQ-1), 305.8 mg/sq. m.
Sequestrant cpd (SQ-2), 100.0 mg/sq. m.

Layer 2: Protective Overcoat Layer

Gelatin, 977.0 mg/sq. m.
Poly(dimethyl siloxane) 200-CS, 65.9 mg/sq. m.
Poly(methyl methacrylate) beads, 5.03 mg/sq. m.
Soluble green absorber dye (AD-1), 32.3 mg/sq. m.
Soluble green absorber dye (AD-2), 32.3 mg/sq. m.
Soluble blue absorber dye (AD-3), 16.1 mg/sq. m.
Soluble red absorber dye (AD-4), 110.8 mg/sq. m.
Spreading aids.

Dispersions B through L were similarly incorporated into the previously described photographic element as elements 2 through 12, respectively, as summarized in Table I.

The elements were exposed for 1/500 second by means of a 3000K Tungsten light source through a 0–3 neutral density step tablet, a heat-absorbing filter, and a filter designed to represent a motion picture color negative film. After exposure, the elements were processed through Process ECP-2B with the exception that those steps specific to sound track development were omitted. The process consisted of a prebath (10"), water rinse (20"), color developer (3'), stop bath (40"), first wash (40"), first fix (40"), second wash (40"), bleach (1'), third wash (40"), second fix (40"), fourth wash (1'), final rinse (10"), and then drying with hot air.

The ECP-2B Prebath consists of:

| | |
|---|---|
| Water | 800 mL |
| Borax (decahydrate) | 20.0 g |
| Sodium sulfate (anhydrous) | 100.0 g |
| Sodium hydroxide | 1.0 g |

-continued

| | |
|---|---|
| Water to make 1 liter | |
| pH @ 26.7° C. is 9.25 +/− 0.10 | |

The ECP-2B Color Developer consists of:

| | |
|---|---|
| Water | 900 mL |
| Kodak Anti-Calcium, No. 4 (40% solution of a pentasodium salt of nitrilo-tri(methylene phosphonic acid) | 1.00 mL |
| Sodium sulfite (anhydrous) | 4.35 g |
| Sodium bromide (anhydrous) | 1.72 g |
| Sodium carbonate (anhydrous) | 17.1 g |
| Kodak Color Developing Agent, CD-2 | 2.95 g |
| Sulfuric acid (7.0 N) | 0.62 mL |
| Water to make 1 liter | |
| pH @ 26.7° C. is 10.53 +/− 0.05 | |

The ECP-2B Stop Bath consists of:

| | |
|---|---|
| Water | 900 mL |
| Sulfuric acid (7.0 N) | 50 mL |
| Water to make 1 liter | |
| pH @ 26.7° C. is 0.90 | |

The ECP-2B Fixer consists of:

| | |
|---|---|
| Water | 800 mL |
| Ammonium thiosulfate (58.0% solution) | 100.0 mL |
| Sodium bisulfate (anhydrous) | 13.0 g |
| Water to make 1 liter | |
| pH @ 26.7° C. is 5.00 +/− 0.15 | |

The ECP-2B Ferricyanide Bleach consists of:

| | |
|---|---|
| Water | 900 mL |
| Potassium ferricyanide | 30.0 g |
| Sodium bromide (anhydrous) | 17.0 g |
| Water to make 1 liter | |
| pH @ 26.7° C. is 6.50 +/− 0.05 | |

The Final Rinse solution consists of:

| | |
|---|---|
| Water | 900 mL |
| Kodak Photo-Flo 200 (TM) Solution | 3.0 mL |
| Water to make 1 liter | |

Processing of the exposed elements was done with the color developing solution adjusted to 36.7° C. The stopping, fixing, bleaching, washing, and final rinsing solution temperatures were adjusted to 26.7° C.

The optical density due to dye formation was then measured on a densitometer using filters in the densitometer appropriate to the intended use of the photographic element. Dye density was then graphed versus log(exposure) to form the Red, Green, and Blue D-logE characteristic curves of the photographic elements.

The processed elements were then irradiated with light from a high intensity 50 Klux Xenon light source for 6 days. After irradiation, the dye density was measured again as described above. The amount of blue density lost due to light fading from an initial blue density of 2.5 for each element is reported in Table I.

TABLE I

60 Day 50 Klux Light Fade Data

| Element No. | Dispersion | Yellow Coupler | Solvent | Delta Blue Density |
|---|---|---|---|---|
| 1 (Invention) | A | Y-1 | None | −0.56 |
| 2 (Invention) | B | Y-2 | None | −0.33 |
| 3 (Invention) | C | Y-3 | None | −0.32 |
| 4 (Invention) | D | Y-4 | None | −0.26 |
| 5 (Invention) | E | Y-5 | None | −0.54 |
| 6 (Invention) | F | Y-6 | None | −0.13 |
| 7 (Comparison) | G | y-1 | DBP | −1.28 |
| 8 (Comparsion) | H | Y-2 | DBP | −0.88 |
| 9 (Comparison) | I | Y-3 | DBP | −1.36 |
| 10 (Comparison) | J | Y-4 | DBP | −0.46 |

TABLE I-continued

| 60 Day 50 Klux Light Fade Data | | | | |
|---|---|---|---|---|
| Element No. | Dispersion | Yellow Coupler | Solvent | Delta Blue Density |
| 11 (Comparison) | K | Y-5 | DBP | −1.03 |
| 12 (Comparison) | L | Y-6 | DBP | −0.50 |

These data clearly show that the removal of di-n-butylphthalate from the dispersion results in a substantial improvement in yellow dye light stability with all of the couplers examined.

Y-1

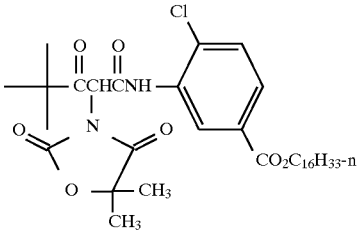

Y-2

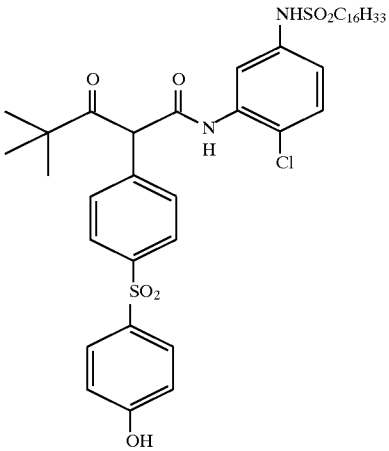

Y-3

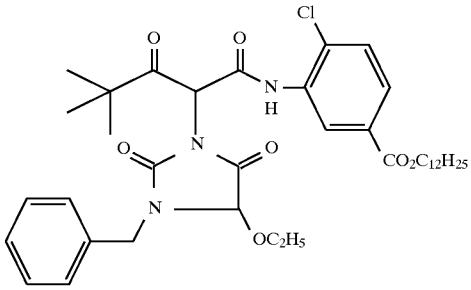

Y-4

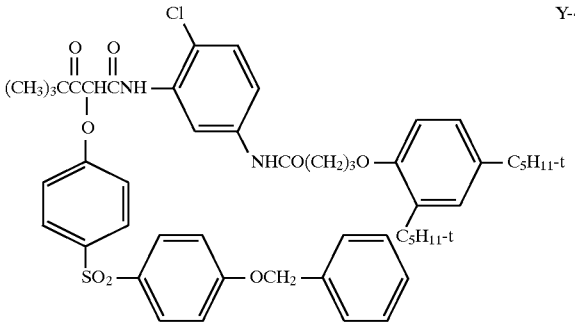

-continued

Y-5

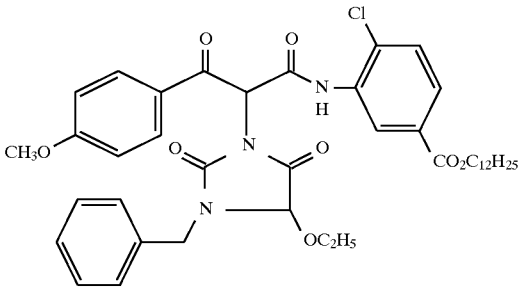

Y-6

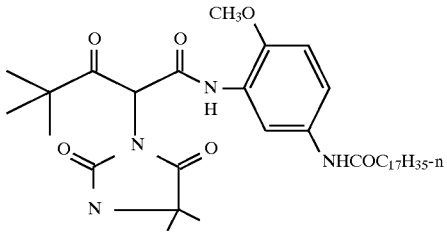

ST-1

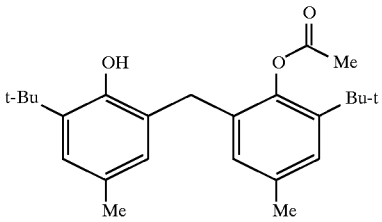

SD-1

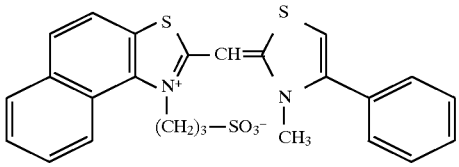

YD-1

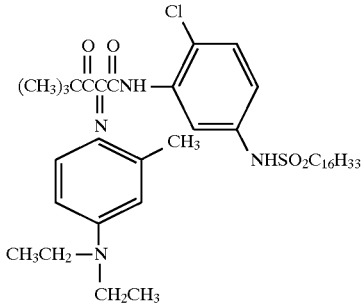

SQ-1

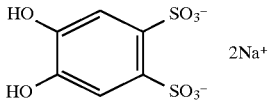

SQ-2

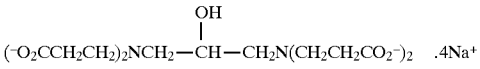

AD-1

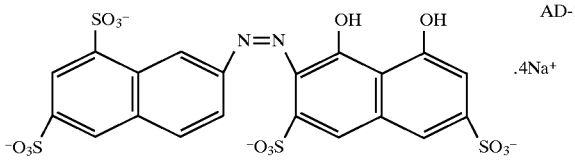

-continued

AD-2

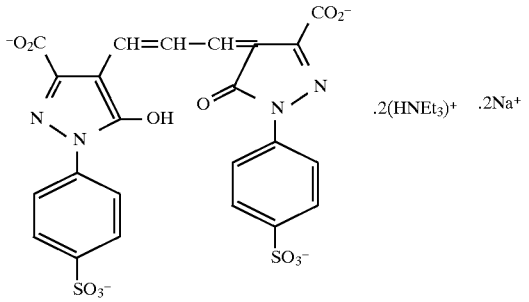

AD-3

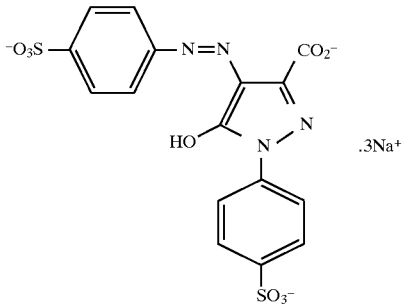

AD-4

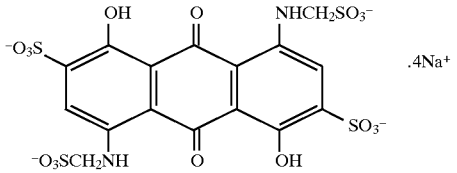

EXAMPLE 2

Dispersion M was prepared like Dispersion A of Example 1. Dispersion N was prepared like Dispersion M, except that 0.9 g of DBP was included in the oil phase and 252.1 g of distilled water was employed in the aqueous phase. Dispersion O was prepared like Dispersion M, except that 2.25 g of DBP was included in the oil phase and 250.75 g of distilled water was employed in the aqueous phase. Dispersion P was prepared like Dispersion M, except that 4.5 g of DBP was included in the oil phase and 248.5 g of distilled water was employed in the aqueous phase. Dispersion Q was prepared like Dispersion M, except that 9.0 g of DBP was included in the oil phase and 244.0 g of distilled water was employed in the aqueous phase. Dispersion R was prepared like Dispersion M, except that 18.0 g of DBP was included in the oil phase and 235.0 g of distilled water was employed in the aqueous phase. These dispersions were coated, exposed, processed, and faded as described in Example 1, except that the yellow coupler level was 1291.2 mg/m$^2$ and the ST-1 level was 322.8 mg/m$^2$ in Layer 1. The amount of blue density lost due to light fading from an initial blue density of 1.7 for each element is given in Table II.

TABLE II

6 Day 50 Klux Light Fade Data

| Element No. | Dispersion | DBP/Coupler | Delta Blue Density |
|---|---|---|---|
| 13 (Invention) | M | 0.0 | −0.33 |
| 14 (Invention) | N | 0.03 | −0.33 |
| 15 (Invention) | O | 0.063 | −0.31 |

TABLE II-continued

6 Day 50 Klux Light Fade Data

| Element No. | Dispersion | DBP/Coupler | Delta Blue Density |
|---|---|---|---|
| 16 (Comparison) | P | 0.125 | −0.48 |
| 17 (Comparison) | Q | 0.25 | −0.77 |
| 18 (Comparison) | R | 0.50 | −0.95 |

These results indicate that the addition of small amounts of DBP (less than 10 wt % of the coupler) caused no degradation in yellow dye light stability, while substantial quantities of DBP (more than 10 wt % of the coupler) significantly worsened dye stability.

EXAMPLE 3

Dispersion R was prepared like Dispersion A of Example 1, except that no light stabilizer was employed. Dispersion S was prepared like Dispersion A, which employed 9.0 g of solid light stabilizer ST-1. Dispersion T was also prepared like Dispersion A, except that 9.0 g of liquid light stabilizer ST-2 (melting point<20° C.) was used instead of ST-1.

ST-2

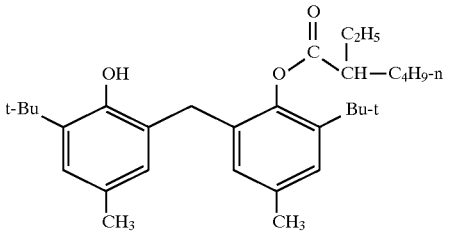

Dispersions U, V, and W were prepared like Dispersions R, S, and T, respectively, except that yellow coupler Y-5 was employed in place of yellow coupler Y- 1. These dispersions were coated, exposed, processed, and faded as described in Example 1, except that the elements were faded for three days. The amount of blue density lost due to light fading from an initial blue density of 2.5 for each element is given in Table III.

TABLE III

3 Day 50 Klux Light Fade Data

| Element No. | Dispersion | Yellow Coupler | Stabilizer | Delta Blue Density |
|---|---|---|---|---|
| 1 (Comparison) | R | Y-1 | None | −0.39 |
| 2 (Invention) | S | Y-1 | ST-1 | −0.16 |
| 3 (Comparison) | T | Y-1 | ST-2 | −0.21 |
| 4 (Comparison) | U | Y-5 | None | −0.46 |
| 5 (Invention) | V | Y-5 | ST-1 | −0.21 |
| 6 (Comparison) | W | Y-5 | ST-2 | −0.28 |

These results indicate that solid light stabilizer ST-1 was more effective in enhancing yellow dye light stability than liquid light stabilizer ST-2 with both types of yellow image couplers.

EXAMPLE 4

A multilayer photographic element in accordance with the invention may be prepared by coating the following layers on a gelatin subbed polyethylene terephthalate support:

Layer 1: Blue Light Sensitive Layer

AgCl cubic grain emulsion, 0.58 micron, spectrally sensitized with SD-1, 0.3336 mmole/Ag mole, 645.6 mg/sq. m.

AgCl cubic grain emulsion, 0.76 micron, spectrally sensitized with SD-1, 0.2669 mmole/Ag mole, 215.2 mg/sq. m.
Yellow dye forming coupler (Y-1), 1291.2 mg/sq. m.
Stabilizer (ST-1), 322.8 mg/sq. m.
Sequestrant cpd (SQ-1), 305.8 mg/sq. m.
Sequestrant cpd (SQ-2), 100.0 mg/sq. m.
Gelatin, 2797.6 mg/sq. m.
Spreading aids.

Layer 2: Interlayer
Oxidized developer scavenger (SC-1), 75.3 mg/sq. m.
Gelatin, 645.6 mg/sq. m.
Spreading aids.

Layer 3: Red Light Sensitive Layer
AgClBr cubic grain emulsion, 25% Br, 0.15 micron, spectrally sensitized with SD-2, 0.1808 mmole/Ag mole, supersensitizer compound (SS-1), 0.6327 mmole/Ag mole, 397.0 mg/sq. m.
AgClBr cubic grain emulsion, 25% Br, 0.24 micron, spectrally sensitized with SD-2, 0.1356 mmole/Ag mole, supersensitizer compound (SS-1), 0.7444 mmole/Ag mole, 44.1 mg/sq. m.
Cyan dye forming coupler (C-1), 914.6 mg/sq. m.
Coupler Solvent (S-1), 548.8 mg/sq. m.
Coupler Solvent (S-2), 548.8 mg/sq. m.
Oxidized developer scavenger (SC-1), 12.9 mg/sq. m.
Gelatin, 3410.9 mg/sq. m.
Spreading aids.

Layer 4: Interlayer
Oxidized developer scavenger (SC-1), 75.3 mg/sq. m.
Gelatin, 645.6 mg/sq. m.
Spreading aids.

Layer 5: Green Light Sensitive Layer
AgClBr cubic grain emulsion, 25% Br, 0.15 micron, spectrally sensitized with SD-3, 0.5273 mmole/Ag mole, supersensitizer compound (SS-1), 1.1212 mmole/Ag mole, 419.6 mg/sq. m.
AgClBr cubic grain emulsion, 25% Br, 0.24 micron, spectrally sensitized with SD-3, 0.4785 mmole/Ag mole, supersensitizer compound (SS-1), 1.3902 mmole/Ag mole, 32.3 mg/sq. m.
Magenta dye forming coupler (M-1), 645.6 mg/sq. m.
Coupler Solvent (S-1), 193.7 mg/sq. m.
Oxidized developer scavenger (SC-1), 53.8 mg/sq. m.
Gelatin, 1915.3 mg/sq. m.
Spreading aids Layer 6: Protective Overcoat Layer
Poly (dimethyl siloxane) 200-CS, 65.9 mg/sq. m.
Poly (methyl methacrylate) beads, 5.0 mg/sq. m.
Gelatin, 977.0 mg/sq. m.
Soluble green absorber dye (AD-1), 32.3 mg/sq. m.
Soluble green absorber dye (AD-2), 32.3 mg/sq. m.
Soluble blue absorber dye (AD-3), 16.1 mg/sq. m.
Soluble red absorber dye (AD-4), 110.8 mg/sq. m.
Gelatin hardener.
Spreading aids.

The following structures represent additional compounds in the above described photographic element.

solvent S-1

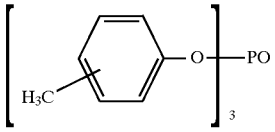

solvent S-2

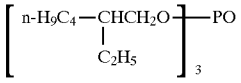

green sensitizing dye SD-3

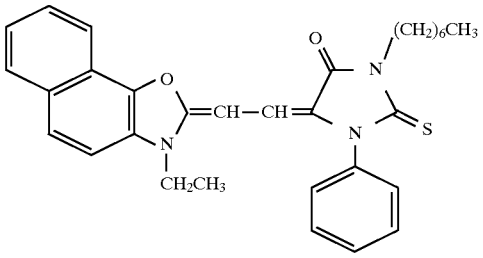

-continued supersensitizer SS-1

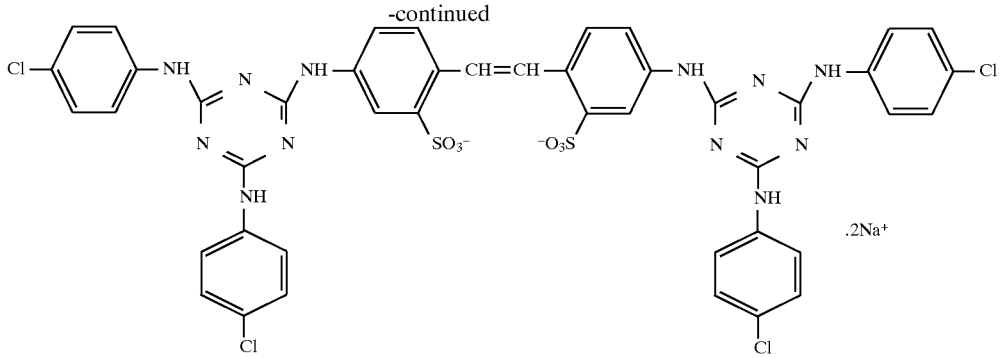

magenta coupler M-1

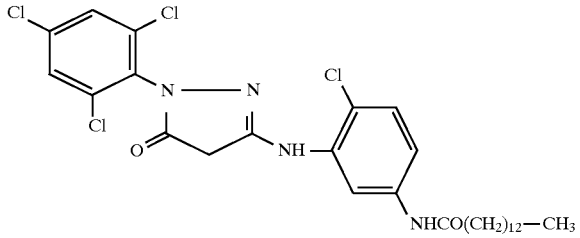

scavenger SC-1

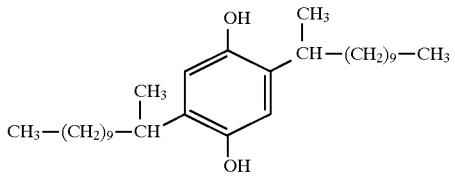

red sensitizing dye SD-2

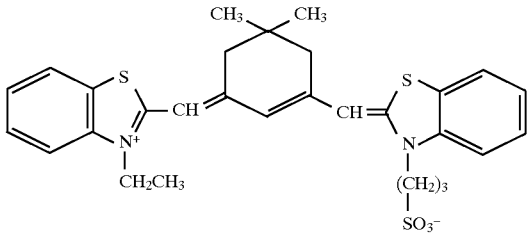

cyan coupler C-1

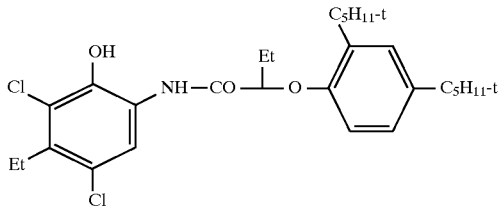

This invention has been described in detail with particular reference to preferred embodiments thereof. It will be understood that variations and modifications can be made within the spirit and scope of the invention.

We claim:

1. A silver halide light sensitive photographic element comprising a support bearing at least one yellow image forming hydrophilic colloid layer comprising yellow image dye forming couplers and a substituted bisphenol light stabilizer compound which has a melting point of greater than 20° C., wherein the yellow image forming layer contains less than 10 wt % high boiling permanent solvent relative to the total amount of yellow coupler in the layer.

2. The element of claim 1, wherein the yellow image forming layer is substantially free of high boiling permanent solvent.

3. The element of claim 1, further comprising at least one cyan image forming layer and at least one magenta image forming layer.

4. The element of claim 1, wherein the substituted bisphenol light stabilizing compound is of the formula:

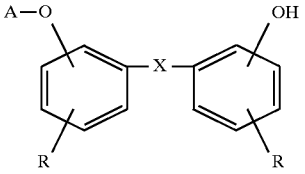

wherein A represents an alkyl, cycloalkyl, alkenyl, aryl, acyl, alkylsulfonyl or arylsulfonyl substituent group, X represents a single bond or a bivalent linking group, and each R independently represents one or more alkyl, alkenyl, cycloalkyl, or aryl substituent group, or in combination with the benzene ring to which it is attached represents the atoms necessary to complete a fused ring system.

5. The element of claim 4, wherein X represents a single bond or an alkylidene group, oxygen, sulfur, selenium, tellurium, or a sulfonyl or phosphinyl group.

6. The element of claim 4, wherein X represents an alkylidene group.

7. The element of claim 1, wherein the weight ratio of yellow coupler to substituted bisphenol light stabilizer is from 1:4 to 20:1.

8. The element of claim 1, wherein the weight ratio of yellow coupler to substituted bisphenol light stabilizer is from 1:1 to 10:1.

9. The element of claim 1, having an effective ISO speed rating of less than about 10.

10. The element of claim 1, wherein the yellow image forming layer comprises silver chloride or bromochloride emulsion grains comprising greater than 50 mole % chloride.

11. The element of claim 10, wherein the emulsion grains have an average equivalent circular diameter of less than 1 micron and an aspect ratio of less than 1.3.

12. A silver halide light sensitive photographic element comprising a support bearing on one side thereof at least one yellow image forming hydrophilic colloid layer comprising a blue-sensitive silver halide emulsion, a yellow image dye forming coupler and a substituted bisphenol light stabilizer compound which has a melting point of greater than 20° C., at least one cyan image forming hydrophilic colloid layer comprising red-sensitive silver halide emulsion and cyan image dye forming coupler, and at least one magenta image forming hydrophilic colloid layer comprising green-sensitive silver halide emulsion and magenta image dye forming coupler, wherein the yellow image forming layer contains less than 10 wt % high boiling permanent solvent relative to the total amount of yellow coupler in the layer.

13. The element of claim 12, wherein each of the blue-sensitive, red-sensitive, and green-sensitive silver halide emulsions comprise silver chloride or silver bromochloride emulsion grains comprising greater than 50 mole % chloride.

14. The element of claim 13, wherein each of the red-sensitive and green-sensitive silver halide emulsions comprise emulsion grains having an average equivalent circular diameter of less than 0.60 micron, and the blue-sensitive silver halide emulsion comprises emulsion grains having an average equivalent circular diameter of less than 0.90 micron.

15. The element of claim 12, having an effective ISO speed rating of less than about 10.

16. The element of claim 12, wherein the yellow image forming layer is substantially free of high boiling permanent solvent.

17. The element of claim 12, wherein the substituted bisphenol light stabilizing compound is of the formula:

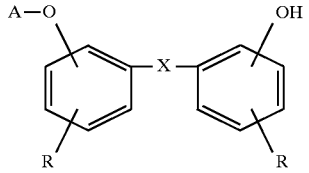

wherein A represents an alkyl, cycloalkyl, alkenyl, aryl, acyl, alkylsulfonyl or arylsulfonyl substituent group, X represents a single bond or a bivalent linking group, and each R independently represents one or more alkyl, alkenyl, cycloalkyl, or aryl substituent group, or in combination with the benzene ring to which it is attached represents the atoms necessary to complete a fused ring system.

18. The element of claim 17, wherein X represents a single bond or an alkylidene group, oxygen, sulfur, selenium, tellurium, or a sulfonyl or phosphinyl group.

19. The element of claim 12, wherein the weight ratio of yellow coupler to substituted bisphenol light stabilizer is from 1:4 to 20:1.

20. The element of claim 12, wherein the weight ratio of yellow coupler to substituted bisphenol light stabilizer is from 1:1 to 10:1.

* * * * *